US007543355B2

(12) United States Patent
Winkler

(10) Patent No.: US 7,543,355 B2
(45) Date of Patent: Jun. 9, 2009

(54) DOOR CLOSER HOUSING

(75) Inventor: Bernd Winkler, Breckerfeld (DE)

(73) Assignee: Dorma GmbH + Co. KG, Ennepetal (DE)

( * ) Notice: Subject to any disclaimer, the term of this patent is extended or adjusted under 35 U.S.C. 154(b) by 197 days.

(21) Appl. No.: 10/592,603

(22) PCT Filed: Mar. 8, 2005

(86) PCT No.: PCT/EP2005/002401

§ 371 (c)(1),
(2), (4) Date: Oct. 17, 2006

(87) PCT Pub. No.: WO2005/088050

PCT Pub. Date: Sep. 22, 2005

(65) Prior Publication Data

US 2008/0000046 A1 Jan. 3, 2008

(30) Foreign Application Priority Data

Mar. 12, 2004 (DE) ..... 10 2004 012 637

(51) Int. Cl.
*E05F 1/00* (2006.01)

(52) U.S. Cl. ..... 16/71

(58) Field of Classification Search ..... 16/71, 16/72, 79–80, 49, 51, 50, 53, 55; 49/404, 49/409, 410, 421; 160/19, 22, 23.1, 37, 38, 160/39

See application file for complete search history.

(56) References Cited

U.S. PATENT DOCUMENTS 3,473,266 A * 10/1969 Miller ..... 49/504
3,777,423 A * 12/1973 Coulter et al. ..... 49/31
4,285,094 A * 8/1981 Levings, Jr. ..... 16/52
5,296,964 A * 3/1994 Shopp ..... 359/443
5,427,168 A * 6/1995 Lohausen ..... 160/66
5,428,278 A * 6/1995 Bollengier et al. ..... 318/446
5,497,533 A * 3/1996 Karlsen ..... 16/71
5,819,830 A * 10/1998 Verelst ..... 160/22

(Continued)

FOREIGN PATENT DOCUMENTS

DE 2 308 243 8/1974

(Continued)

OTHER PUBLICATIONS

Search Report dated Jul. 11, 2005 for the underlying International Application No. PCT/EP2005/002401.

*Primary Examiner*—Chuck Y. Mah
(74) *Attorney, Agent, or Firm*—Cohen Pontani Lieberman & Pavane LLP

(57) ABSTRACT

A door closer housing includes a mounting bracket having a L-shaped cross section, a first leg mountable on a supporting surface, and a second leg connected to the first leg and extending perpendicularly therefrom. The door closer also includes a cover mountable on the mounting bracket to form a housing for accommodating a door closer mechanism, the housing having two opposite open ends, the cover having a U-shaped cross section. When each end cap is mounted onto one of the open ends of the housing, the end wall of said each end cap faces an outside of the housing, and the cover extends into a plane of the end wall of said each end cap.

16 Claims, 6 Drawing Sheets

U.S. PATENT DOCUMENTS

| | | | | |
|---|---|---|---|---|
| 6,446,394 | B1 * | 9/2002 | Finke et al. | 49/409 |
| 6,557,303 | B2 * | 5/2003 | Finke et al. | 49/409 |
| 2004/0078928 | A1 * | 4/2004 | Roberts et al. | 16/210 |

FOREIGN PATENT DOCUMENTS

| | | |
|---|---|---|
| DE | 100 23 761 | 11/2001 |
| GB | 1 375 889 | 11/1974 |
| WO | WO 98/49419 | 11/1998 |

* cited by examiner

DOOR CLOSER HOUSING

CROSS-REFERENCE TO RELATED APPLICATIONS

This is a U.S. national stage of International Application No. PCT/EP2005/002401, filed on 8 Mar. 2005. Priority is claimed on German Application No. 10 2004 012 637.2, filed on 12 Mar. 2004.

BACKGROUND OF THE INVENTION

1. Field of the Invention

The invention relates to a door closer or the like having a housing, whereby a cover can be mounted to the housing and whereby each front side of the housing is closed by an end cap, which has an end surface oriented towards the outside.

2. Description of the Related Art

Such door closers are very well known. The housings, which accommodate the actual door closer mechanism, generally are visually not very appealing and they can only partially be adapted to individual customer needs. Very often, it is especially disturbing that the housing does not seem to be homogeneous.

SUMMARY OF THE INVENTION

Therefore, it is an object of the present invention to provide a novel door closer, which leaves a pleasing impression also from the visual point of view.

This object is achieved with a door closer or the like having a housing, whereby a cover can be mounted to the housing and whereby each front side of the housing is closed by an end cap, which has an end surface oriented towards the outside, characterized in that the cover extends as far as into the plane of the end surface.

As a result of this embodiment, a door closer is provided, which, through its overall homogeneous appearance, is visually particularly appealing and very slim.

Advantageous further developments with become apparent from the following discussion.

According to an advantageous further embodiment, the housing has a mounting bracket, which is L-shaped in cross-section, the vertical leg thereof serving to attach the mounting bracket at a door, at a door frame, at a wall or the like, and the door closer mechanism being mountable to the horizontal leg thereof. As a result of the L-shape, such mounting bracket is not only easy to mount to the door, to the door frame, to the wall or the like, but it also offers excellent mounting and maintenance properties for the actual door closer mechanism, as the door closer mechanism is exposed on almost all sides and therefore is easily accessible.

Preferably, the cross-section of the cover is U-shaped with open front sides, such that mounting the door closer to the mounting bracket is simple and quick to realize.

For guaranteeing a reliable fixing of the cover at the mounting bracket, according to an advantageous further development, the cover is maintained at the mounting bracket via a positive snap connection.

This snap connection is preferably formed in that it includes two extensions protruding inwards at the free ends of the U-shaped cover and two projections cooperating therewith, protruding outwards and being located in the are of the vertical leg of the mounting bracket.

Advantageously, the cover is formed as an extruded profile to achieve sufficient torsional strength.

A particular visual effect can be obtained if, according to a preferred embodiment, a shadow gap, which is visible from the front side of the housing, is formed between the cover and the end cap.

The shadow gap is preferably realized by means of a notch (recess) provided on three sides of the end cap. No notch is provided on the fourth side, such that, once completely mounted, the end cap covers the vertical leg of the mounting bracket without any gap.

For easy installation of the end cap at the mounting bracket, according to an advantageous further development, the end cap is slidable onto a fastening component mounted to the mounting bracket.

Advantageously, the fastening component is formed as an angle section, the one leg thereof being connectable to the horizontal leg of the mounting bracket and the other leg thereof being located in front of the front side of the housing. The connection to the horizontal leg of the mounting bracket is preferably realized via a screw connection, such as to allow for a fast and nevertheless releasable fastening.

Advantageously, the leg located in front of the front side of the housing has a substantially circular attachment ring with a peripheral groove. As a result of the circular shape, the end cap is easy to mount, because no particular aligning operations need to be carried out. The peripheral groove guarantees a reliable and accurate positioning of the end cap.

In order to be able to easily and simply mount the end cap to the attachment ring, according to a preferred embodiment, the end cap is provided with an inside located wall, which has an oblong hole open to one side. Thus, it is easy to slide the end cap onto the attachment ring.

In order to guarantee a reliable support of the end cap at the attachment ring, according to an advantageous further embodiment, in the installed state, the edges of the oblong hole, which is open to one side, engage in the groove of the attachment ring. Therefore, the end cap is reliably and accurately positioned and held at the attachment ring.

The reliable support can be even improved in that, if, in an advantageous manner, the lateral edges of the oblong hole are provided with one projection each, which, in the installed state, engages with the attachment ring by means of a snap connection.

For aesthetical reasons, the front side of the end cap can be provided with a hole pattern, preferably in the shape of blind holes.

According to a preferred embodiment, the housing is longer than the actual door closer mechanism, such as to leave some free space available in the housing: e.g. to accommodate a drive. If, furthermore, the housing of the door closer has a height/depth ratio of about 5/4, the overall door closer can be formed in a visually appealing way.

According to an advantageous further development, the housing is about 49 mm high and about 37 mm deep.

Furthermore, a particularly appealing visual impression can be obtained, if the housing extends over the total width of the door and/or if a slide channel cooperating with the door closer presents the same length as the housing of the door closer.

With the inventive door closer, the housing can be attached at the door or the like and the slide channel at an associated door frame or the like. According to an alternative embodiment, also the slide channel can be attached at the door or the like and the housing at an associated door frame or the like.

BRIEF DESCRIPTION OF THE DRAWINGS

Further details, features and advantages of the invention will result from the following description of a preferred exemplary embodiment, based on the figures, in which.

DETAILED DESCRIPTION OF THE PRESENTLY PREFERRED EMBODIMENTS

In the illustration, only the relevant parts are depicted, all other structural components have been omitted for clarity's sake.

Figure 11:
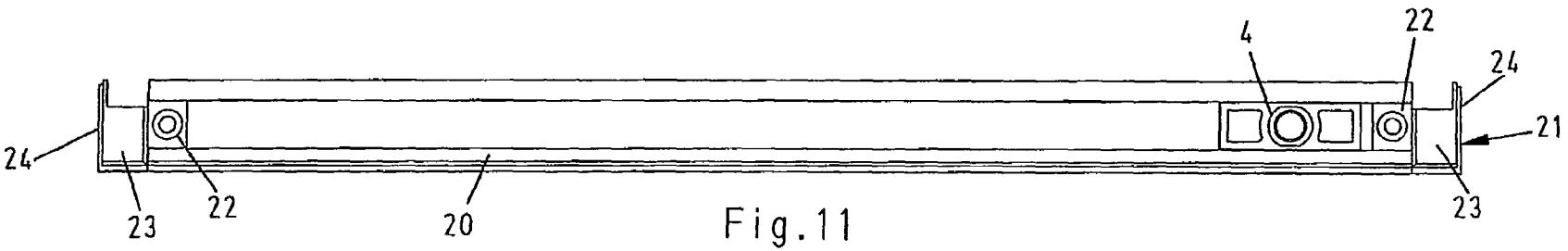
FIG. 11: shows a plan view on a slide channel.
Figure 12:
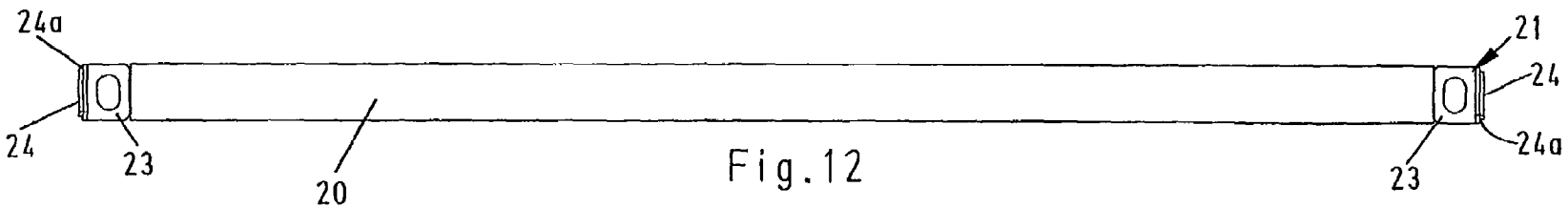
FIG. 12: shows the frontal view of the slide channel according to FIG. 11.

A door closer has a housing 1, wherein the actual door closer mechanism (not shown) is accommodated. In known manner, a drive shaft 2, to which an arm assembly 3 is fastened, protrudes from the housing 1, which assembly, at its other end, carries a slide member 4 (see FIG. 11) guided in a slide channel 5.

The housing 1 has an L-shaped mounting bracket 6, the vertical leg 6*a* thereof being provided with bores 7 for attaching the mounting bracket 6 at a door, at a door frame, at a wall or the like. The horizontal leg 6*b* of the mounting bracket 6 is provided with attachment bores 8 for the actual door closer mechanism, with through holes 9 for the drive shaft 2, with access holes 10 for valves provided in the door closer mechanism, and with holding bores 11 for fastening components 12 to be mounted to the front sides of the mounting bracket 6. The attachment bores 8, the through holes 9 and the access holes 10 are provided twofold at the mounting bracket 6, such as to allow for using the same mounting bracket 6 for right and left closing door closers.

Figure 4:
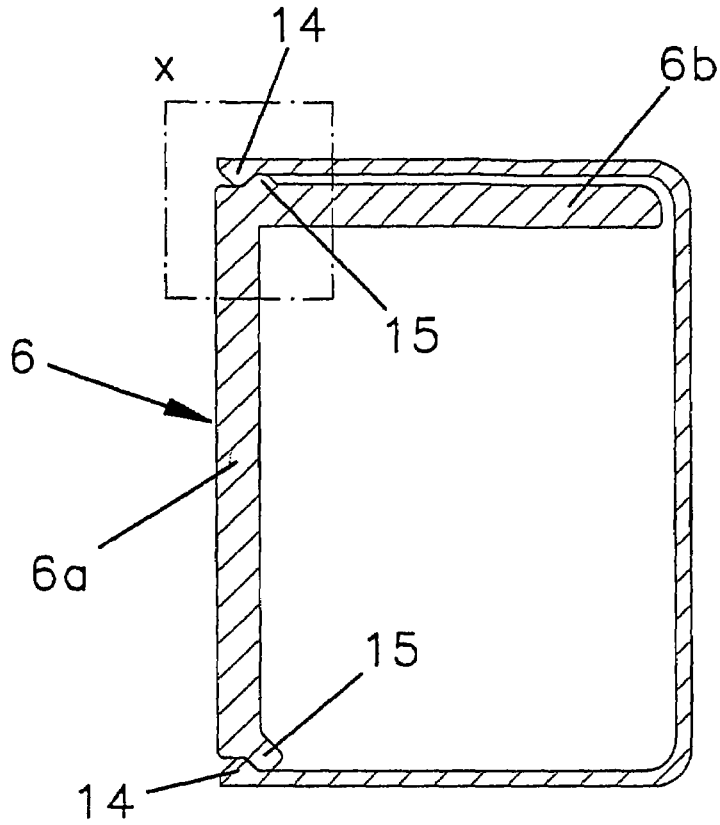
FIG. 4: shows a section through the housing of the door closer according to FIG. 1.

Furthermore, the housing 1 of the door closer has a U-shaped cover 13 formed as an extruded profile, which is open at the front sides thereof. A section through the mounting bracket 6, with the cover 13 being installed, is shown in FIG. 4. A positive snap connection, which is illustrated in detail in FIG. 5, is provided for latching the cover 13 at the mounting bracket 6.

Figure 5:
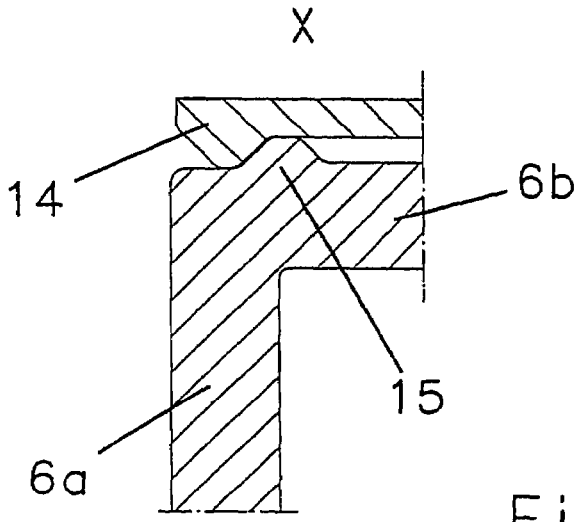
FIG. 5: shows a detailed view of the particular detail X of FIG. 4.
Figure 6:
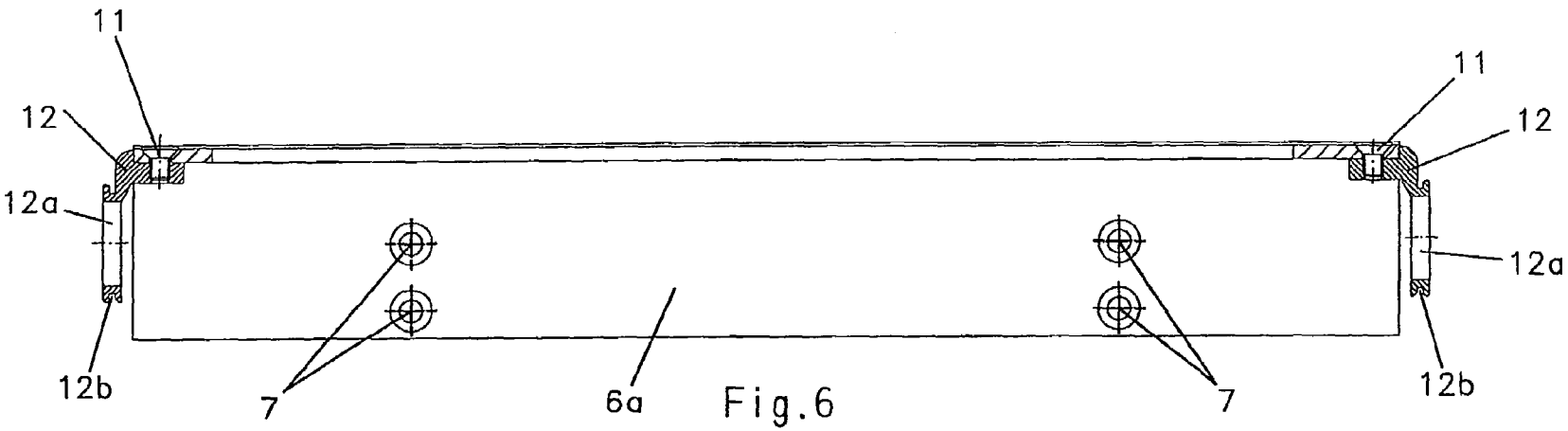
FIG. 6: shows a view of the mounting bracket from the rear side.
Figure 7:
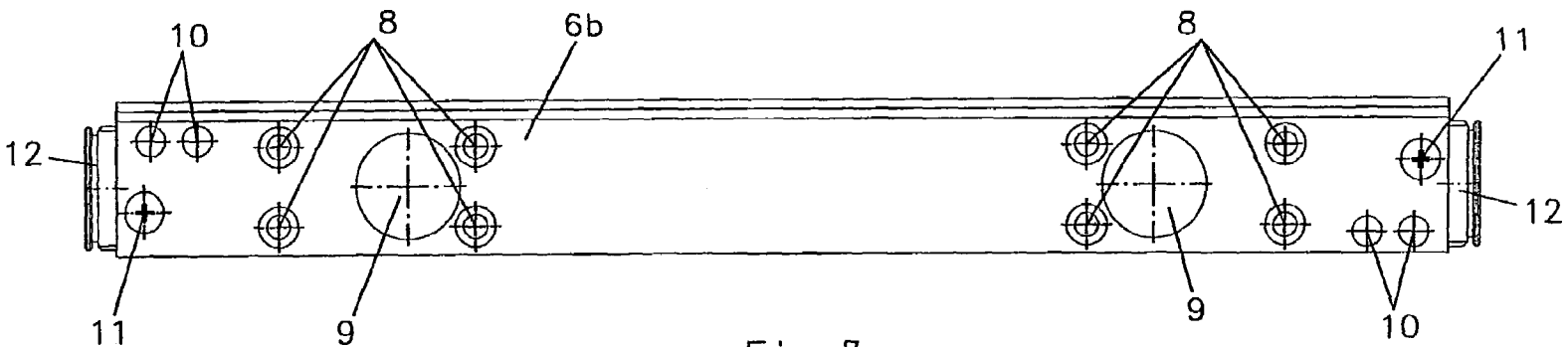
FIG. 7: shows a view of the mounting bracket from above.
Figure 9:
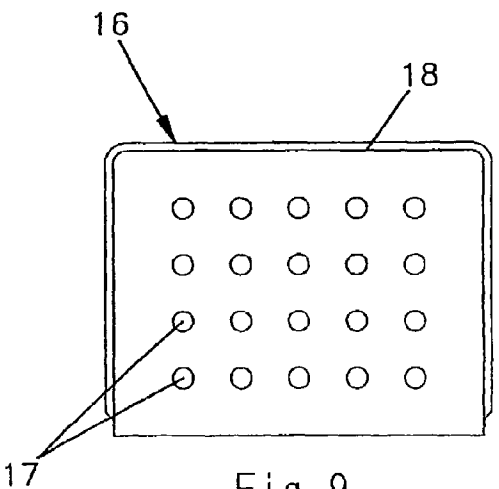
FIG. 9: shows a view on the front side of the end cap according to FIG. 8.
Figure 10:
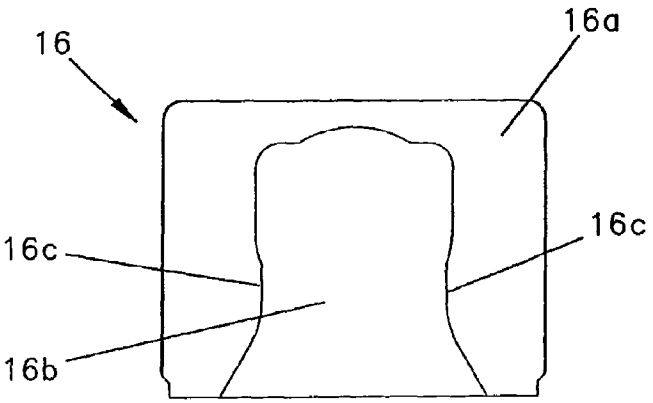
FIG. 10: shows an inside view of the end cap according to FIG. 8.
Figure 8:
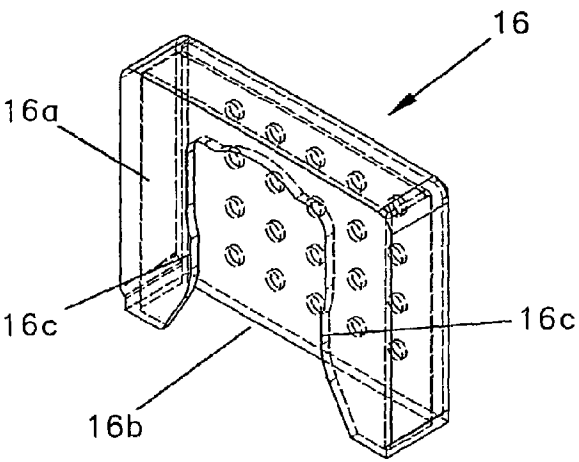
FIG. 8: shows a perspective view of an end cap.

The snap connection consists of extensions 14 protruding inwards at the free ends of the U-shaped cover 13 and being able to engage rearwards with projections 15 protruding outwards and being located in the area of the 15 vertical leg 6*a* of the mounting bracket 6, as can be seen in FIG. 4 and FIG. 5.

The front sides of the housing 1 are closed off by end caps 16, which can be slid onto the fastening components 12 mounted to the horizontal leg 6*b* of the mounting bracket 6. For this purpose, the fastening component 12 is formed as an angle section. If the one leg of the fastening component 12 is connected to the horizontal leg 6*b* of the mounting bracket 6, the other leg will be located in front of the front side of the housing 1. The leg located in front of the front side of the housing 1 has a substantially circular attachment ring 12*a* with a peripheral groove 12*b*.

Furthermore, each end cap 16 has an inside located wall 16*a*, which has an oblong hole 16*b* open to one side. It is via this oblong hole 16*b* that the end cap 16 can be slid onto the attachment ring 12*a* such that the edges of the oblong hole 16*b* engage in the groove 12*b* of the attachment ring 12*a*. In order to guarantee a reliably positioned snap connection between the end cap 16 and the fastening component 12, the lateral edges of the oblong hole 16*b* are provided with one extension 16*c* each, which, in the installed state, engages rearwards with the attachment ring 12*a*.

Furthermore, the side of the end cap 16 oriented outwards is decorated with a hole pattern 17, which, in the illustrated exemplary embodiment, consists of symmetrically arranged blind holes; however, it may have different forms or embodiments.

The end cap 16 has a notch (recess) on three sides of the circumference thereof, which forms a shadow gap 18 between the end cap 16 and the cover 13.

Figure 2:
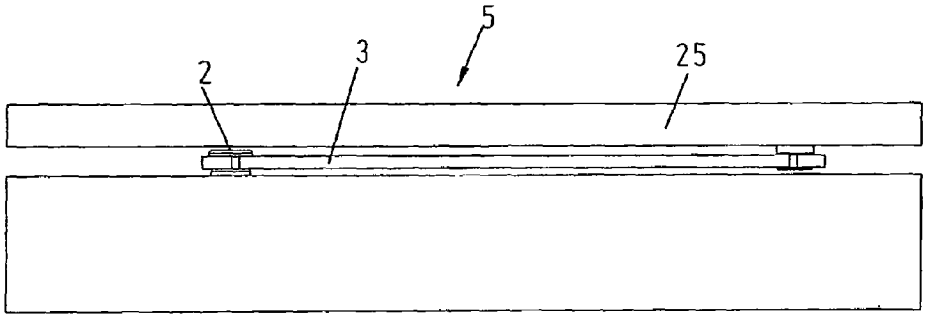
FIG. 2: shows a frontal view of the inventive door closer according to FIG. 1.
Figure 1:
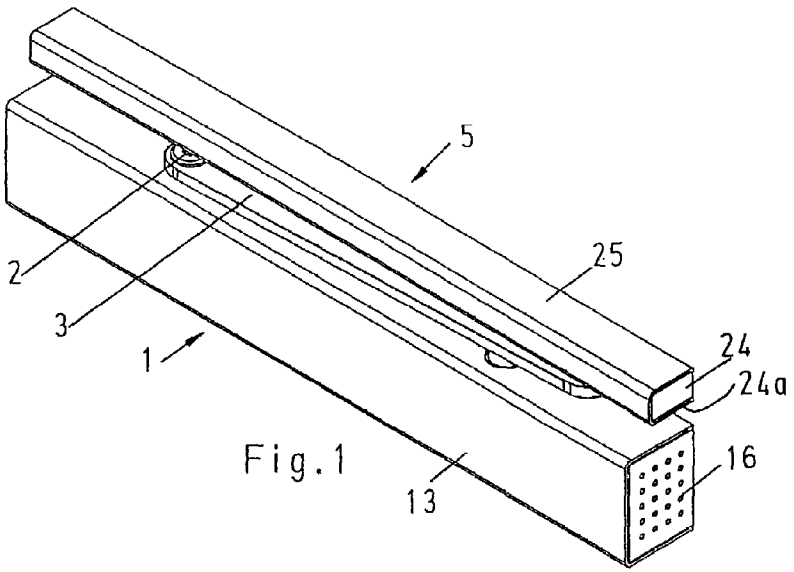
FIG. 1: shows a perspective illustration of an inventive door closer.
Figure 3:
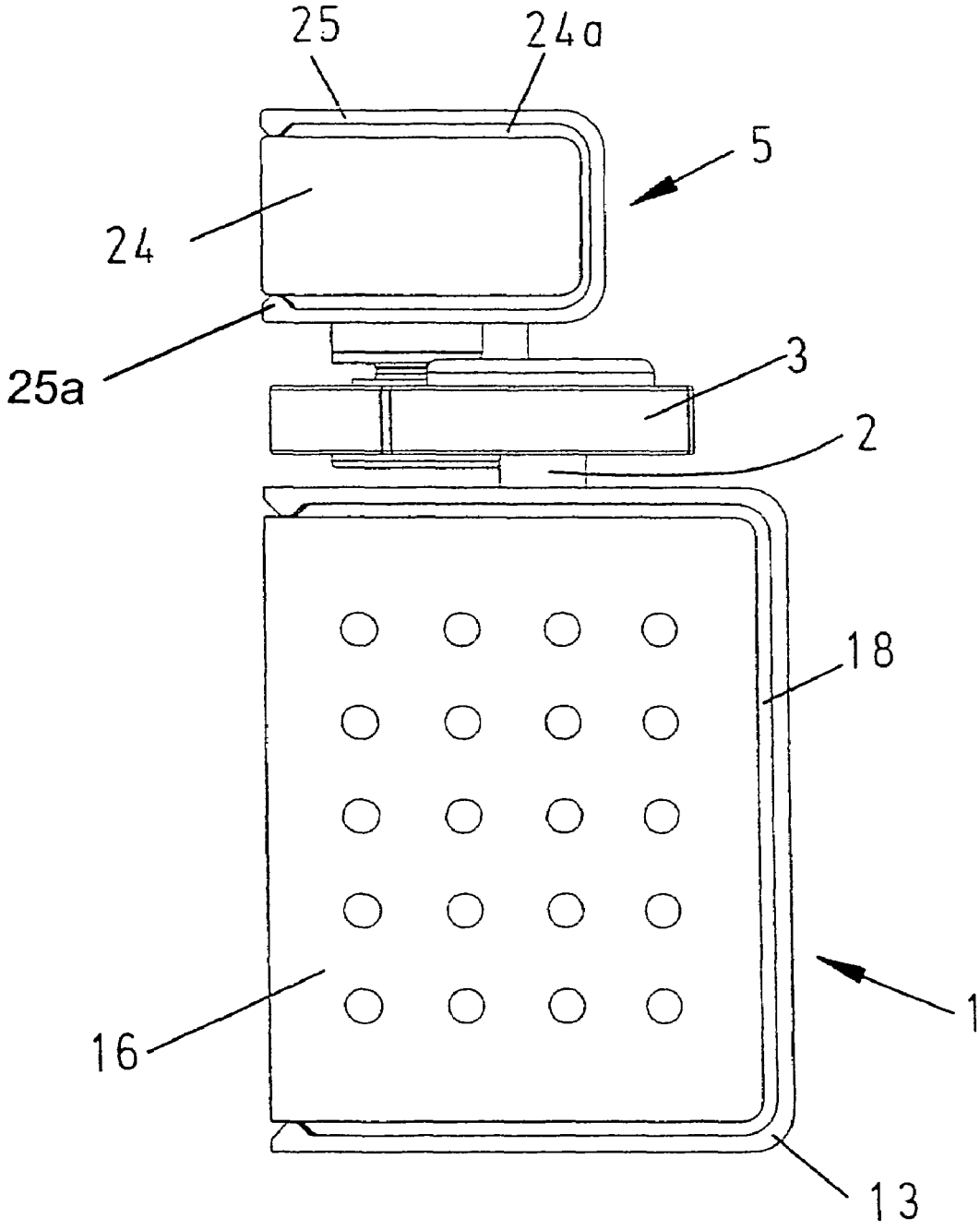
FIG. 3: shows an end view of the inventive door closer according to FIG. 1.

In the installed state, the cover 13 does not only cover the mounting bracket 6, but also the end caps 16, as can be seen particularly well in FIG. 2, such that the end caps 16 are not visible in a frontal view as the open terminal surfaces of the cover 13 and the end surfaces of the end caps 16 are located in one plane. As already explained, the notch provided on three sides of the end caps 16 forms a shadow gap 18 between the end caps 16 and the cover 13. As no notch is provided on the fourth side of the end cap 16, the end caps 16 cover the vertical leg 6*a* of the mounting bracket 6 on this side, such that the latter can not be seen.

The entire housing 1 is relatively small and has a height/depth ratio of about 5/4. It is in particular about 49 mm high and about 37 mm deep.

The slide channel 5 has a similar embodiment as the housing 1. It includes a C-shaped guide rail 20 wherein the slide member 4 is guided and which rail is open at its front sides. Attachment parts 21, by means of which the guide rail 20 can be attached at the door, at the door frame, at the wall or the like, can be inserted into these open front sides.

Each attachment part 21 includes a shoulder 22, which is insertable into the guide rail 20, of a holding block 23, provided with an attachment bore for fastening the guide rail 20, and of an end wall 24. The end wall 24—like the end cap 16—is provided with a notch on three sides of its circumference to form a shadow gap 24*a*.

The guide rail 20—like the mounting bracket 6—can be covered with a U-shaped cover element 25, which is open at the front sides thereof. For attaching the cover element 25 at the guide rail 20, snap cams 25*a* protruding inwards are provided in the area of the free ends of the U-shaped cover element 25, which cooperate with snap openings in the guide rail 20.

In the mounted state, the cover element 25 does not only cover the guide rail 20, but also covers the attachment parts 21 such that, as can be seen particularly in FIG. 2, the attachment parts 21 can not be seen in a frontal view, as the open terminal surfaces of the cover element 25 and the end walls 24 of the attachment parts 21 are located in one plane. As already explained, the notch provided on three sides of the end walls 24 forms a shadow gap 24*a* between the attachment parts 21 and the cover element 25. As no notch is provided on the fourth side of the end wall 24, the end wall 24 covers the guide rail 20 on this side, such that the latter can not be seen.

The housing 1 may be longer than the actual door closer mechanism, such that there is space available in the housing 1, e.g. for a drive. The housing 1 may extend over the entire width of the door. For reasons of symmetry, the slide channel 5 is as long as the housing 1.

Depending on the application, the housing 1 can be attached at the door, and the slide channel 5 at the door frame or at a wall, or the slide channel 5 can be attached at the door and the housing 1 at the door frame or at a wall.

Employing the cover 13 for the door closer and the cover element 25 for the slide channel 5 allows for a particularly individual adaptation to fittings used for doors. The cover 13 and the cover element may be comprised of different materials, particularly of aluminium, stainless steel or plastic material, which, other than individuals forms, may have different surface treatments.

What is claimed is:

1. A door closer housing comprising:

a mounting bracket having a L-shaped cross section, a first leg mountable on a supporting surface, and a second leg connected to the first leg and extending perpendicularly therefrom;

a cover mountable on the mounting bracket to form a housing for accommodating a door closer mechanism, the housing having two opposite open ends, the cover having a U-shaped cross section;

two fastening components mountable to the mounting bracket, wherein each fastening component comprises an angle section having an inside leg connectable to the second leg of the mounting bracket, and an outside leg which is disposed outside the cover and in front of one of the open ends when the inside leg is connected to the second leg of the mounting bracket; and two end caps, each end cap being insertable into one of the fastening components and operable to cover one of the open ends of the housing and having an end wall, wherein when each end cap is mounted onto one of the fastening components, the end wall of said each end cap faces an outside of the housing and the end wall of said each end cap is flush with the one of the open ends.

2. The door closer housing of claim 1, wherein the cover is held in place on the mounting bracket by a positive snap connection.

3. The door closer housing of claim 2, wherein the positive snap connection comprises two projections protruding outward from the mounting bracket, and two extensions protruding inward from the cover.

4. The door closer housing of claim 1, having a gap between the cover and said end wall of each end cap when said each end cap is mounted to the housing.

5. The door closer housing of claim 4, wherein each end cap has four sides, and a notch on three of the four sides, and wherein the gap is formed by the notch.

6. The door closer housing of claim 5, wherein each end cap covers the first leg of the mounting bracket without any gap.

7. The door closer housing of claim 1, wherein the outside leg of each fastening component has a substantially circular attachment ring with a peripheral groove.

8. The door closer housing of claim 7, wherein each end cap further has an inside wall, the inside wall having two spaced inside edges which extend inward from one side of the inside wall and define an oblong hole.

9. The door closer housing of claim 8, wherein the inside edges of the inside wall of each end cap is operable to engage the peripheral groove of one of the fastening components.

10. The door closer housing of claim 9, wherein each of the inside edges has an extension so that the inside edges of the inside wall of each end cap are operable to snap into the peripheral groove of one of the fastening components.

11. The door closer housing of claim 1, wherein the end wall of each end cap has a plurality of blind holes.

12. The door closer housing of claim 1, wherein the housing is arranged and dimensioned to accommodate a drive.

13. The door closer housing of claim 1, wherein the housing has a height/depth ratio of approximately 5/4.

14. The door closer housing of claim 1, wherein the housing has a height of approximately 49 mm, and a depth of approximately 37 mm.

15. The door closer housing of claim 1, further comprising a slide channel and an arm assembly connecting the housing and the slide channel, wherein the housing has a length which is equal to a length of the slide channel.

16. The door closer housing of claim 1, wherein the cover is comprised of at least one of aluminium, stainless steel and plastic material.

* * * * *